US008692857B2

(12) United States Patent
Jimbo

(10) Patent No.: US 8,692,857 B2
(45) Date of Patent: Apr. 8, 2014

(54) PRINTER

(75) Inventor: Takashi Jimbo, Chiba (JP)

(73) Assignee: Seiko InstrumentsInc. (JP)

( * ) Notice: Subject to any disclaimer, the term of this patent is extended or adjusted under 35 U.S.C. 154(b) by 25 days.

(21) Appl. No.: 13/428,266

(22) Filed: Mar. 23, 2012

(65) Prior Publication Data

US 2012/0242772 A1 Sep. 27, 2012

(30) Foreign Application Priority Data

Mar. 24, 2011 (JP) ..... 2011-065831
Oct. 31, 2011 (JP) ..... 2011-239420

(51) Int. Cl.
*B41J 2/32* (2006.01)

(52) U.S. Cl.
USPC ..... 347/197

(58) Field of Classification Search
USPC ..... 347/197; 400/120.16, 120.17
See application file for complete search history.

(56) References Cited

U.S. PATENT DOCUMENTS

2003/0184640 A1 10/2003 Sasaki ..... 347/197

FOREIGN PATENT DOCUMENTS

| | | |
|---|---|---|
| JP | 2001180071 | 7/2001 |
| JP | 2003211776 | 7/2003 |
| JP | 2007168350 | 7/2007 |

*Primary Examiner* — Kristal Feggins
(74) *Attorney, Agent, or Firm* — Adams & Wilks

(57) ABSTRACT

A printer performs printing on a thermal paper drawn from roll sheets having different widths. The printer has a thermal head and a platen roller arranged opposite to the thermal head and mounted to undergo rotation for sending out the thermal paper in a state of sandwiching the thermal paper between the thermal head and the platen roller. Elastic members are arrayed along the width direction of the thermal paper and are provided on an opposite side of the platen roller with respect to the thermal head for pressing the thermal head toward the platen roller. Only one of the elastic members is provided with a pressing force releasing mechanism for separating the one elastic member from the thermal head according to a width of the one roll sheet from which the thermal paper is drawn and for releasing pressing of the thermal head by the one elastic member.

20 Claims, 7 Drawing Sheets

PRINTER

BACKGROUND OF THE INVENTION

1. Field of the Invention

The present invention relates to a printer for performing printing of various types of information on a thermal paper drawn from a roll sheet.

2. Description of the Related Art

A large number of thermal printers of various types are presently provided in which printing is performed by pressing a thermal head against a special thermal paper (heat sensitive sheet) which undergoes a color change when heat is applied thereto. In particular, the thermal printer is suitably used in printing a variety of labels, receipts, and tickets because it is possible to perform the printing of smooth letters and various graphics without using toners, inks, or the like.

The above-mentioned thermal printer performs printing by sandwiching a thermal paper between a platen roller and a thermal head, and by heating a printing surface (heat sensitive surface) of the thermal paper by heating elements of the thermal head while feeding the thermal paper through rotation of the platen roller, thereby causing a color development of the printing surface. The thermal paper used in the thermal printer is a roll sheet type thermal paper in many cases, which is rolled in a roll shape. Roll sheets of several types each having a different width (for example, 3-inch width, 4-inch width, and so on) are provided, and used while appropriately selected according to the application.

Moreover, for the above-mentioned thermal printer, there is a demand for a single thermal printer that selectively performs printing on roll sheets each having a different width according to the printing purposes and applications.

However, in a conventional configuration, in a case of using a roll sheet having a smaller width (hereinafter, referred to as second roll sheet) than that of a roll sheet having a maximum usable width (hereinafter, referred to as first roll sheet), between the thermal head and the platen roller, on a widthwise outer side of the second roll sheet, a contact region is present in which the thermal paper does not pass through and the thermal head and the platen roller are brought into direct contact with each other. In the contact region, abrasion between the thermal head and the platen roller may cause a reduction of a feeding force due to a worn surface of the platen roller, damage of a protective film on the surface of the thermal head, and the like.

In this context, it is conceivable that platen rollers respectively corresponding to the widths of the roll sheets are prepared, and only the sizes of the platen rollers are changed according to size changes of the roll sheets. However, this configuration leads to a problem of an increase in cost of the apparatus.

Accordingly, for example, there is known the following configuration described in JP 2007-168350 A. Specifically, an application point of a resultant force of pressing forces, which are imparted to the thermal paper (platen roller) by the head springs supporting the thermal head, is set between a first center being a widthwise center of the first roll sheet, and a second center being a widthwise center of the second roll sheet.

However, the above-mentioned configuration of JP 2007-168350 A has a problem that, in a case of using the second roll sheet, the pressing force imparted to the contact region between the thermal head and the platen roller cannot be reduced yet fully.

SUMMARY OF THE INVENTION

Therefore, the present invention has been made in view of such circumstances, and provides a printer capable of handling a plurality of roll sheets each having a different width in the same apparatus while actively reducing the pressing force to be imparted to the region in which the thermal head and the platen roller are brought into direct contact with each other.

In order to solve the above-mentioned problem, the present invention provides the following measures.

According to an exemplary embodiment of the present invention, there is provided a printer for performing printing on a plurality of kinds of roll sheets each having a different width, including: a thermal head including a large number of heating elements and being arranged along a width direction of a thermal paper to be drawn from one of the plurality of kinds of roll sheets; a platen roller arranged opposite to the thermal head, for sending out the thermal paper by rotating in a state of sandwiching the thermal paper between the thermal head and the platen roller; and an elastic member provided on an opposite side of the platen roller with respect to the thermal head, for pressing the thermal head toward the platen roller, in which the elastic member includes a plurality of elastic members arrayed along the width direction, and in which, of the plurality of elastic members, at least one elastic member is provided with a pressing force releasing mechanism for separating the at least one elastic member from the thermal head according to a width of the one of the plurality of kinds of roll sheets to be fed, and for releasing pressing of the thermal head by the at least one elastic member.

With this configuration, in a case of using a roll sheet having a smaller width (hereinafter, referred to as second roll sheet) than that of a roll sheet having a maximum width (hereinafter, referred to as first roll sheet), it is possible to release a pressing force acting from the at least one elastic member to the head support member. With this, between the thermal head and the platen roller, it is possible to reduce the pressing force acting to a region in which the second roll sheet is not present (contact region in which the thermal head and the platen roller are brought into direct contact with each other). Thus, it is possible to actively reduce contact pressure (platen pressure) between the thermal head and the platen roller in the contact region, and hence friction load between the thermal head and the platen roller can be reduced. Therefore, while reducing damage caused by abrasion between the thermal head and the platen roller, it is possible to handle the plurality of kinds of roll sheets each having a different width in the same apparatus.

In addition, when compared to a conventional case in which a plurality of kinds of platen rollers are separately prepared according to the widths of the roll sheets, it is also possible to reduce cost of the apparatus.

Further, in the printer according to the exemplary embodiment of the present invention, the pressing force releasing mechanism includes a lever member for moving the at least one elastic member and enabling the at least one elastic member to be brought into contact with and separated from the thermal head.

With this configuration, through moving the at least one elastic member and enabling the at least one elastic member to be brought into contact with and separated from the thermal head by operation of the lever member, a user himself/herself can easily perform an operation of releasing the pressing force, which can improve usability.

Further, in the printer according to the exemplary embodiment of the present invention, the pressing force releasing mechanism includes a positioning portion for keeping the at least one elastic member at a contact position at which the at least one elastic member is brought into contact with the thermal head, and at a separated position at which the at least one elastic member is separated from the thermal head.

With this configuration, it is possible to position the at least one elastic member at the contact position and the separated position, and hence it is possible to improve reliability of the apparatus.

Meanwhile, according to another exemplary embodiment of the present invention, there is provided a printer for performing printing on a plurality of kinds of roll sheets each having a different width, including: a thermal head including a large number of heating elements and being arranged along a width direction of a thermal paper drawn from one of the plurality of kinds of roll sheets; a platen roller arranged opposite to the thermal head, for sending out the thermal paper by rotating in a state of sandwiching the thermal paper between the thermal head and the platen roller; and an elastic member provided on an opposite side of the platen roller with respect to the thermal head, for pressing the thermal head toward the platen roller, in which the elastic member includes a plurality of elastic members arrayed along the width direction, and in which, of the plurality of elastic members, at least one elastic member is provided with a pressing force releasing mechanism for moving the at least one elastic member so as to increase a stroke of the at least one elastic member according to a width of the one of the plurality of kinds of roll sheets to be fed, and for reducing pressing of the thermal head by the at least one elastic member.

Further, in the printer according to the another exemplary embodiment of the present invention, the pressing force releasing mechanism includes a lever member for moving the at least one elastic member so as to reduce a pressing force acting on the thermal head.

Further, in the printer according to the another exemplary embodiment of the present invention, the pressing force releasing mechanism includes a positioning portion for keeping the at least one elastic member at a pressing force imparting position at which the at least one elastic member generates an elastic force biasing the thermal head, and at a pressing force releasing position at which the elastic force is reduced by increasing the stroke of the at least one elastic member.

With the printer according to the present invention, it is possible to handle the plurality of kinds of roll sheets each having a different width in the same apparatus while actively reducing the pressing force to be imparted to the region in which the thermal head and the platen roller are brought into direct contact with each other.

DETAILED DESCRIPTION OF THE PREFERRED EMBODIMENTS

Thermal Printer

Figure 1:
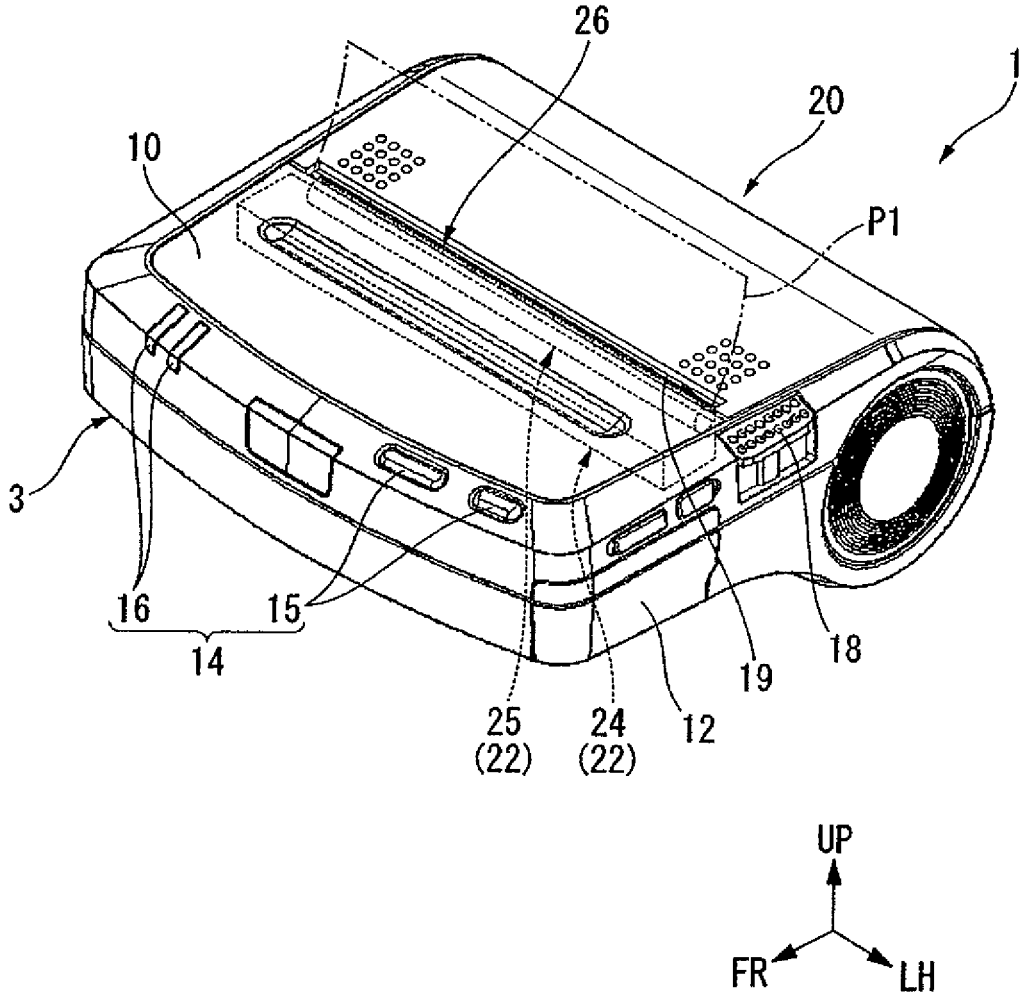
FIG. 1 is a perspective view illustrating a state in which a paper cover of a thermal printer according to an embodiment of the present invention is at a closed position.
Figure 2:
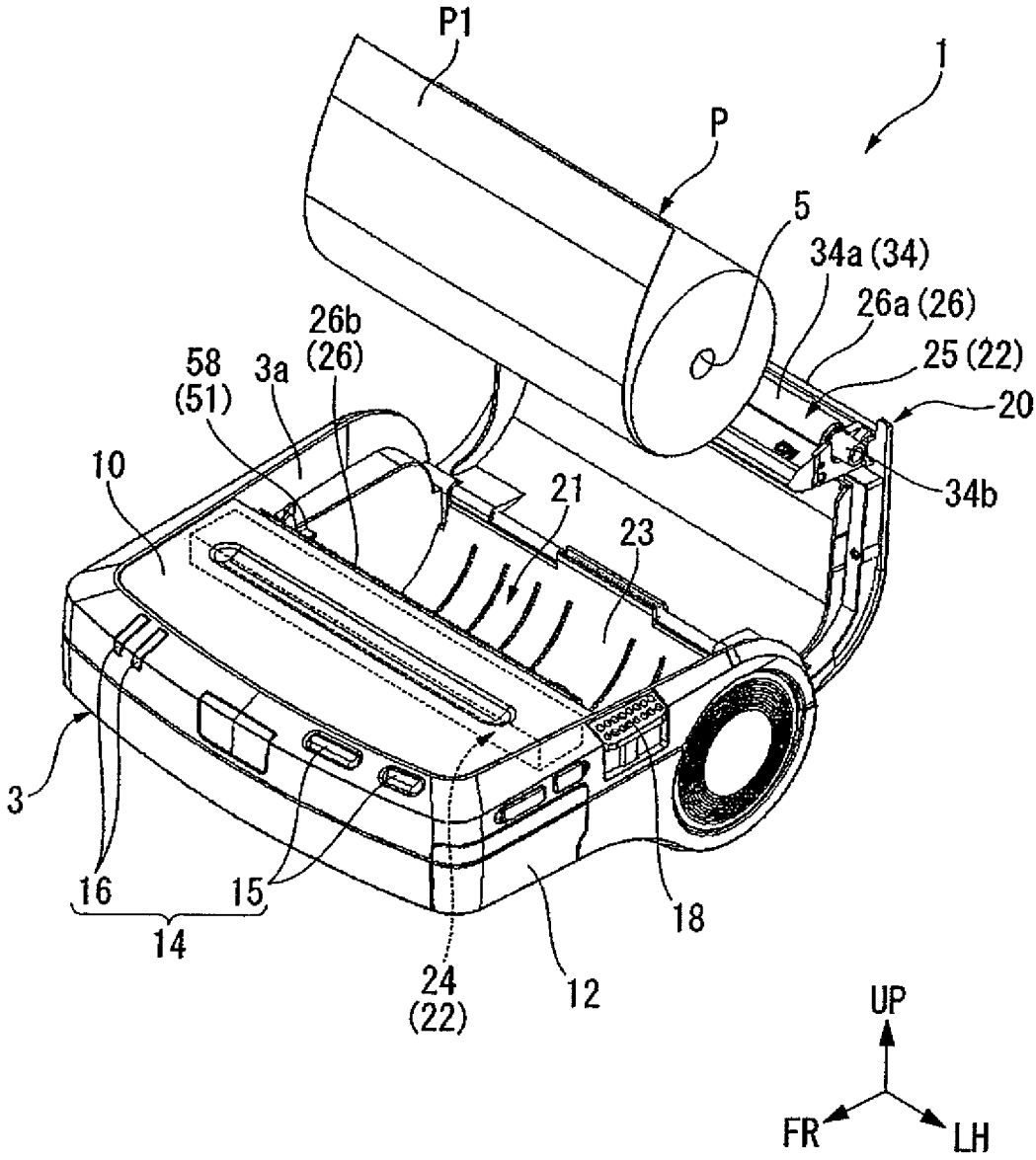
FIG. 2 is a perspective view illustrating a state in which the paper cover of the thermal printer according to the embodiment of the present invention is at an open position.

Next, embodiments of the present invention are described with reference to the drawings. FIG. 1 is a perspective view illustrating a state in which a paper cover of a thermal printer is at a closed position, and FIG. 2 is a perspective view illustrating a state in which the paper cover is at an open position. Note that, in the following description, for easy understanding of the invention, illustrations are simplified, as appropriate, by omitting a part of a component, simplifying a shape, changing a contraction scale, etc. Further, in the drawings, FR, LH, and UP represent a front side, a left side, and an upper side of the printer, respectively.

As illustrated in FIGS. 1 and 2, a thermal printer (printer) 1 is configured to be capable of performing printing on a plurality of kinds of thermal papers P1 each having a different width. The thermal paper P1 is a heat sensitive sheet which undergoes a color change when heat is applied thereto, and the thermal paper P1 is used suitably for printing a variety of labels, receipts, and tickets. The thermal paper P1 is set in the thermal printer 1 in a state of a roll sheet P which is obtained by rolling the thermal paper P1 so as to have a hollow hole 5, and printing is performed on a part drawn from the roll sheet P. Note that, in the following, first, description is made of a set state of the roll sheet P having a maximum width (for example, 4-inch width) settable in the thermal printer 1.

From an outward appearance, the thermal printer 1 includes a casing 3 having an opening portion 3*a* (see FIG. 2), and a paper cover 20 which is supported on the casing 3 so as to be swingable and opens/closes the opening portion 3*a* of the casing 3. Further, inside the thermal printer 1, a roll sheet accommodating portion 21 and a printing module 22 are provided.

The casing 3 is made of plastics such as polycarbonate, or a metal material. A front portion of the casing 3 is formed into substantially a rectangular parallelepiped shape having an upper wall 10, whereas a rear portion thereof is formed into a box shape opening upward. On the upper wall 10 of the casing 3, operation portions 14 for performing a variety of operations of the thermal printer 1 are arranged. As the operation portions 14, a variety of function switches 15 such as a power switch and a FEED switch are arranged, and a variety of indicator lamps 16 are arranged, such as a POWER indicator lamp provided adjacent to the function switches 15, for indicating ON/OFF information of the power switch, and an ERROR indicator lamp for indicating an error and the like of the thermal printer 1. Further, between the upper wall 10 and a side wall 12 of the casing 3, an open button 18 for the paper cover 20 is provided.

The paper cover 20 is made of plastics such as polycarbonate. The paper cover 20 is supported at its rear end on the casing 3 by a hinge shaft (not shown) so as to be swingable, and a front end of the paper cover 20 is engageable with the casing 3 by an engagement portion (not shown). Further, through pressing the above-mentioned open button 18 of the casing 3, the casing 3 and the paper cover 20 are disengaged from each other, and thus the paper cover 20 can be opened and closed between a closed position (see FIG. 1) and an open position (see FIG. 2). Further, when the paper cover 20 is at the closed position, between a front end edge of the paper cover 20 and a rear end edge of the upper wall 10 of the casing 3, a clearance is formed along a width direction of the thermal paper P1, and the clearance forms a paper outlet 19 (see FIG. 1) through which the printed thermal paper P1 is discharged.

As illustrated in FIG. 2, the roll sheet accommodating portion 21 is formed in the opening portion 3*a* at the rear portion of the casing 3. Specifically, the roll sheet accommodating portion 21 includes a guide plate 23 for holding the roll sheet P, and the guide plate 23 and an inner surface of the paper cover 20 hold the roll sheet P so as to cover the same. The guide plate 23 is a member which is provided inside the casing 3 and has an arc cross-section. One end of the guide plate 23 extends to the rear end side of the above-mentioned paper cover 20, and the other end thereof extends to a position close to the printing module 22. That is, on an inner peripheral surface of the guide plate 23, an outer peripheral surface of the roll sheet P is held in a contact state, and to the printing module 22, the guide plate 23 guides the thermal paper P1 drawn from the roll sheet P.

Figure 3:
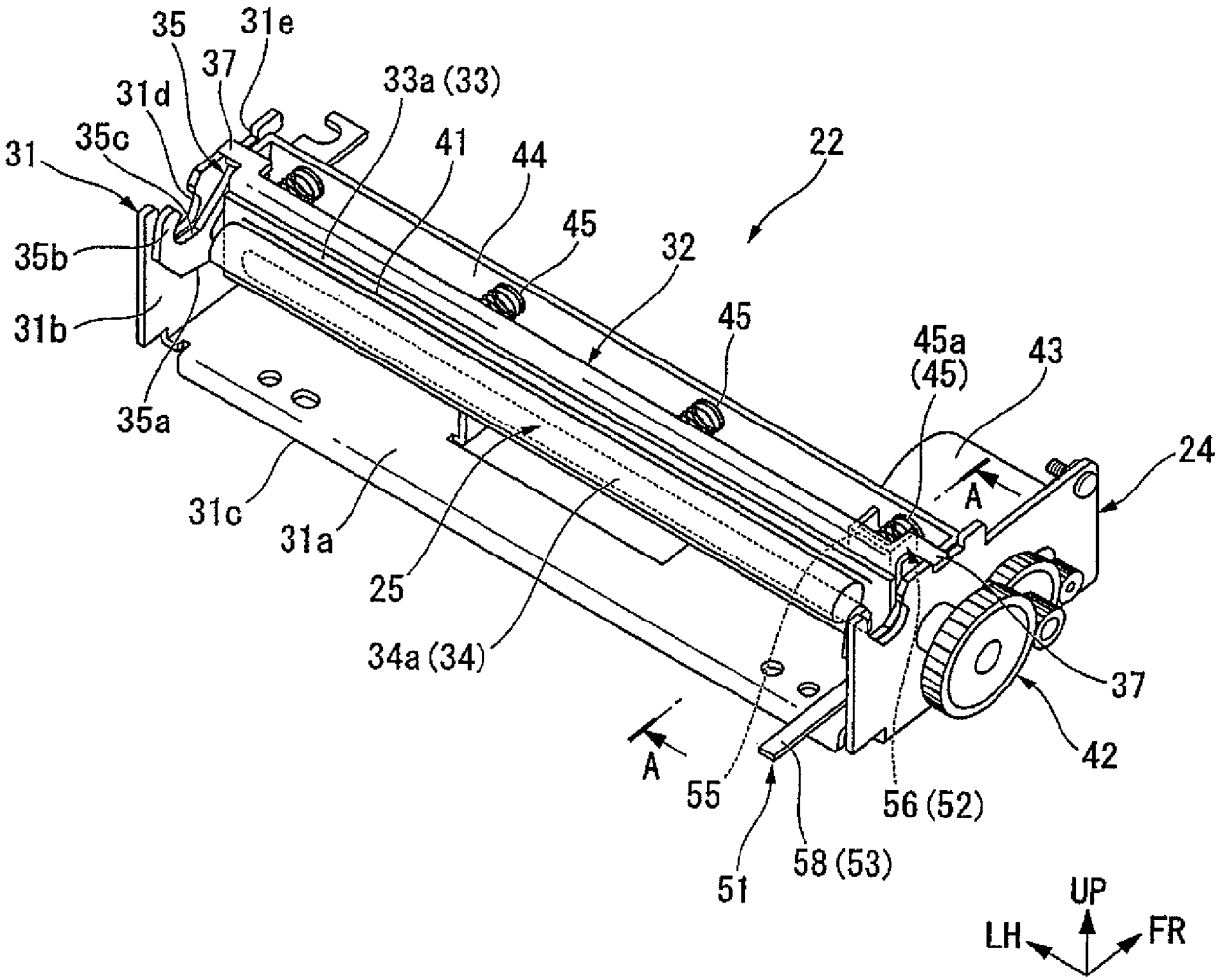
FIG. 3 is a perspective view of a printing module.

FIG. 3 is a perspective view of the printing module.

As illustrated in FIGS. 2 and 3, the printing module 22 includes: a main body unit 24 provided at the rear end edge of the upper wall 10 of the casing 3; a platen unit 25 provided at the front end edge of the paper cover 20 and detachably combined with the main body unit 24; and a cutting unit 26 for cutting the thermal paper P1 printed by the printing module 22.

As illustrated in FIG. 3, the main body unit 24 includes a main body frame 31, a head support member 32 supported on the main body frame 31, a thermal head 33 bonded and fixed onto the head support member 32, and a pair of lock arms 35 for rotatably holding a platen roller 34 of the platen unit 25, which is described below, with respect to the main body frame 31.

The main body frame 31 is a plate-like member including a bottom wall portion 31*a* extending in a right-left direction, and a pair of side wall portions 31*b* provided so as to extend upward from both end portions of the bottom wall portion 31*a* in the right-left direction. At a rear end edge of the bottom wall portion 31*a*, a guide portion 31*c* bent downward is formed. The guide portion 31*c* guides the thermal paper P1, which is guided from the above-mentioned guide plate 23, to between the thermal head 33 and the platen roller 34 (to a downstream side in a conveying direction).

At an upper end edge of each side wall portion 31*b*, a slit 31*d* cut downward is formed. Into the slit, each end portion of the platen roller 34 is fitted.

The head support member 32 is a flat-plate-like member having its right-left direction along a longitudinal direction. The head support member 32 is arranged between the side wall portions 31*b*, and the thermal head 33 is bonded and fixed onto a rear surface of the head support member 32. Further, a lower end side of the head support member 32 is supported by a shaft 38 (see FIG. 4) so as to be swingable. Both axial end portions of the shaft 38 are fixed to the side wall portions 31*b*, respectively. With this configuration, the head support member 32 swings about the shaft 38 to a front-rear direction. Further, at upper end portions of the head support member 32, stoppers 37 for regulating a swing range of the head support member 32 are formed. The stopper 37 extends outward in the right-left direction of the head support member 32, and is formed so as to face an inside of a recess 31*e* formed in an upper portion of the side wall portion 31*b* of the main body frame 31. Further, the stopper 37 moves inside the recess 31*e* along with the swing of the head support member 32 and can be brought into contact with both end surfaces of the recess 31*e*. Further, the stopper 37 abuts against the end surfaces of the recess 31*e*, to thereby regulate further swing of the head support member 32.

The thermal head 33 performs printing on the thermal paper P1 conveyed into the printing module 22, and is bonded and fixed onto the head support member 32 and formed into a rectangular shape in plan view (viewed from the front-rear direction). In this case, the thermal head 33 is arranged inside the upper wall 10 of the casing 3 so as to be exposed in the opening portion 3*a*, and is arranged in a state in which a longitudinal direction of the thermal head 33 corresponds to the width direction of the thermal paper P1. Further, on a head surface 33*a* of the thermal head 33, a large number of heating elements 41 are arrayed in parallel to the right-left direction and in an aligned pattern. Note that, the head surface 33*a* is a surface opposing to a printing surface of the thermal paper P, and the head surface 33*a* and an outer peripheral surface of the platen roller 34 sandwich the thermal paper P. The heating elements 41 of the thermal head 33 are controlled so as to generate heat based on a signal from a control portion (not shown). Through controlling heat generation of the heating elements 41, letters and figures of various types can be printed on the printing surface of the thermal paper P1.

As illustrated in FIGS. 2 and 3, the platen unit 25 is provided at the front end edge of the paper cover 20, and includes the platen roller 34 which is attachable/detachable to/from the main body frame 31 along with closing/opening of the paper cover 20. The platen roller 34 is provided so that, when the paper cover 20 is at the closed position, the peripheral surface of the platen roller 34 is held in contact with the thermal head 33 in a state of sandwiching the thermal paper P1 drawn from the roll sheet P between the thermal head 33 and the platen roller 34. Specifically, the platen roller 34 includes a roller shaft 39 (see FIG. 4) supported onto the paper cover 20 so as to be rotatable, and a rubber roller main body 34*a* mounted on the roller shaft 39.

At each end portion of the roller shaft 39, a bearing 34*b* (see FIG. 2) is mounted. The bearing 34*b* is held between the slit 31*d* of the side wall portion 31*b* and the lock arm 35 so that the platen roller 34 is held so as to be rotatable about a center axis and to be attachable/detachable to/from the main body frame 31. Further, a driven gear (not shown) is fixed to one axial end of the platen roller 34, and meshes with a gear transmission mechanism 42 fixed to the main body frame 31 side when the platen roller 34 is held on the pair of side wall portions 31*b*. The gear transmission mechanism 42 is connected to driving means 43 such as a motor, and transmits a rotational driving force from the driving means 43 to the driven gear. With this configuration, the platen roller 34 rotates in a state of being supported on the pair of side wall portions 31*b*, and thus can send out the thermal paper P1. Note that, when the platen roller 34 is separated from the main body unit 24 (slits 31*d* and lock arms 35) along with an opening operation of the paper cover 20, combination is released.

In the above-mentioned main body unit 24, in front of the head support member 32, a flat-plate-like elastic member support plate 44 extending substantially in parallel to the head support member 32 is arranged. Further, a plurality of (for example, four) elastic members 45 are interposed between the head support member 32 and the elastic member support plate 44 along the right-left direction, and bias the elastic member support plate 44 and the head support member 32 in directions so as to separate the same from each other. That is, the elastic members 45 always press the head support member 32 toward the platen roller 34.

The above-mentioned lock arm 35 is a member integrally extending rearward from each end portion of the above-mentioned elastic member support plate 44 in the right-left direction. The lock arm 35 includes an arm portion 35*a* formed on a proximal end side (front end side), and a hook portion 35*b* formed on a distal end side (rear end side).

The arm portions 35*a* extend rearward from the both end portions of the elastic member support plate 44 so as to interpose the head support member 32 therebetween, and are supported so as to be swingable about the above-mentioned shaft 38. Therefore, the elastic member support plate 44 and the lock arms 35 are swingable about the shaft 38 to the front-rear direction. Further, at the time of the forward swing (swing to an opposite side of the head support member 32) of the above-mentioned elastic member support plate 44 and the lock arms 35, the elastic member support plate 44 abuts against the main body frame 31, to thereby regulate the further swing of the elastic member support plate 44 and the lock arms 35.

The hook portion 35*b* is provided so as to extend from the distal end side of the arm portion 35*a* so as to cover an outer peripheral surface of the bearing 34*b* of the platen roller 34. In an inner peripheral edge of the hook portion 35*b*, a recess 35*c* for supporting the outer peripheral surface of the bearing 34*b* of the platen roller 34 is formed. The recess 35*e* and the slit 31*d* of the side wall portion 31*b* hold the bearing 34*b* of the platen roller 34.

As described above, the pair of lock arms 35 are formed integrally with the elastic member support plate 44, and the elastic member support plate 44 and the head support member 32 are biased by the elastic members 45 in opposite directions. Thus, each of the lock arms 35 can hold the platen roller 34 to keep the platen roller 34 rotatable while the recess 35*c* of the hook portion 35*b* and the slit 31*d* sandwich the bearing 34*b* of the platen roller 34.

As illustrated in FIG. 2, the cutting unit 26 includes: a first cutting blade 26*a* provided on the downstream side relative to the platen roller 34 in the conveying direction of the thermal paper P1 and formed integrally with the front end edge of the paper cover 20; and a second cutting blade 26*b* provided on the downstream side relative to the thermal head 33 and formed integrally with the rear end edge of the upper wall 10 of the casing 3. Further, the thermal paper P1 having passed the thermal head 33, that is, the printed thermal paper P1 is sent out through the paper outlet 19 formed between the first cutting blade 26*a* and the second cutting blade 26*b*, and then cut by being pulled down in a contact state with the first cutting blade 26*a* or the second cutting blade 26*b*.

(Pressing Force Releasing Mechanism)

Figure 4:
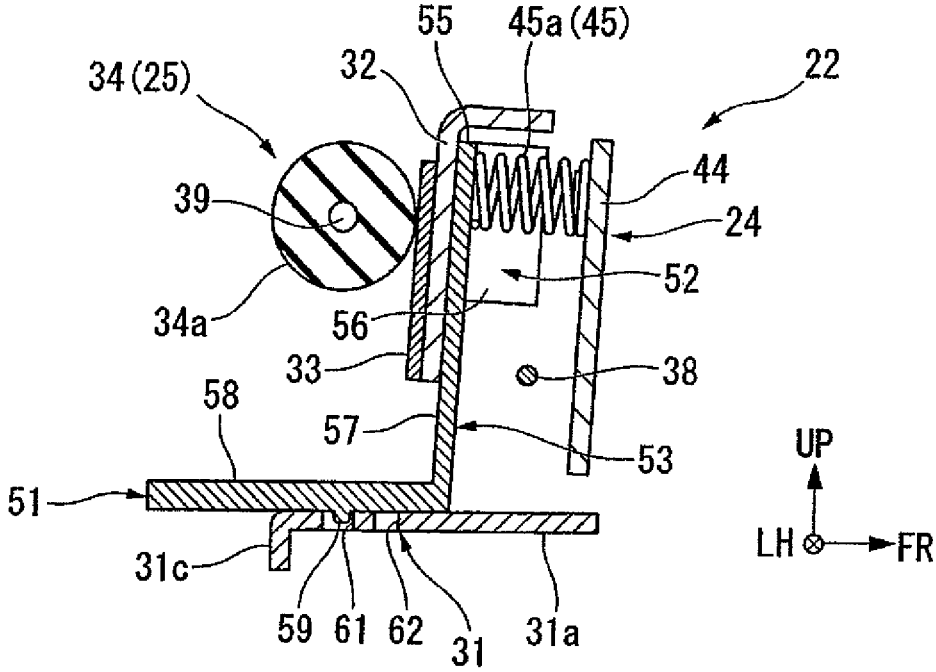
FIG. 4 is a sectional view taken along the line A-A of FIG. 3.

FIG. 4 is a sectional view taken along the line A-A of FIG. 3.

Here, as illustrated in FIG. 4, of the above-mentioned elastic members 45, an elastic member 45*a*, which is provided on one end side (gear transmission mechanism 42 side) in the right-left direction, is provided with a pressing force releasing mechanism 51 for enabling the elastic member 45*a* to be brought into contact with and separated from the head support member 32.

The pressing force releasing mechanism 51 includes a bearing surface 52 for supporting the head support member 32 side (rear end side) in an expansion/contraction direction (front-rear direction) of the elastic member 45*a*, and a lever member 53 connected to the bearing surface 52, for operating the pressing force releasing mechanism 51.

The bearing surface 52 is a C-shaped member opening forward, and includes a bottom wall portion 55 arranged between the head support member 32 and the elastic member 45*a*, and side wall portions 56 provided upright and forward from both right and left sides of the bottom wall portion 55.

The bottom wall portion 55 is arranged on a front surface of the head support member 32, for supporting one end of the elastic member 45*a*. Note that, the other end of the elastic member 45*a* abuts against the elastic member support plate 44.

The respective side wall portions 56 are formed so as to surround both sides of the elastic member 45*a* in the right-left direction, and a gap is formed between a distal end portion (front end portion) of each of the side wall portions 56 and the elastic member support plate 44.

The lever member 53 includes an extending portion 57 extending downward from a lower end portion of the bottom wall portion 55, and an operation portion 58 extending rearward from a lower end portion of the extending portion 57.

The extending portion 57 extends downward along the front surface of the head support member 32, and the lower end portion of the extending portion 57 reaches the bottom wall portion 31*a* of the main body frame 31.

The operation portion 58 extends rearward over the bottom wall portion 31*a* of the main body frame 31, and a distal end portion (rear end portion) of the operation portion 58 protrudes to the rear of the bottom wall portion 31*a*. Specifically, the rear end portion of the operation portion 58 extends so as to face the inside of the above-mentioned roll sheet accommodating portion 21. Through gripping the operation portion 58 through the opening portion 3*a* of the casing 3, the pressing force releasing mechanism 51 can be operated. That is, through operating the operation portion 58 along the front-rear direction, the pressing force releasing mechanism 51 is movable along the front-rear direction. Note that, in FIG. 2, for easy understanding of the drawing, the operation portion 58 is exaggeratedly illustrated, but it is preferred that the operation portion 58 do not interfere with the roll sheet P fed into the roll sheet accommodating portion 21, and be provided at such a position as to allow a user to grip the operation portion 58 through the opening portion 3*a*.

Further, on a lower surface of the operation portion 58, a protruding portion 59 protruding downward is formed. The protruding portion 59 can be received in a plurality of positioning holes 61, 62 formed in the bottom wall portion 31*a* of the main body frame 31. The positioning holes 61, 62 are formed so as to be aligned and spaced in the front-rear direction at positions overlapping the protruding portion 59 when viewed from the front-rear direction. Further, when the protruding portion 59 is received in any one of the positioning holes 61, 62, an outer peripheral surface of the protruding portion 59 and an inner peripheral surface of the one of the positioning holes abut against each other, to thereby regulate movement of the pressing force releasing mechanism 51 in the front-rear direction.

In this case, the pressing force releasing mechanism 51 is movable between a pressing force imparting position (contact position) (see FIG. 4) at which the protruding portion 59 is received in, of the positioning holes 61, 62, the positioning hole 61 formed on the rear side, and a pressing force releasing position (separated position) (see FIG. 5) at which the protruding portion 59 is received in the positioning hole 62 formed on the front side. That is, the above-mentioned protruding portion 59 and the positioning holes 61, 62 function as positioning portions for positioning the pressing force releasing mechanism 51 at the pressing force imparting position and the pressing force releasing position, respectively. In this case, at the pressing force imparting position, the elastic member 45*a* abuts against the head support member 32 through intermediation of the bottom wall portion 55, to thereby press the head support member 32 toward the platen roller 34. Meanwhile, at the pressing force releasing position, the elastic member 45*a* and the bottom wall portion 55 are separated from the head support member 32 so that the pressing of the head support member 32 by the elastic member 45*a* is released.

(Way of Actuating Thermal Printer)

Next, a way of actuating the above-mentioned thermal printer 1 is described. Note that, in the following, description is mainly made of a first roll sheet mode in which printing is performed on the roll sheet P having a maximum width (for example, 4-inch width) settable in the thermal printer 1 (hereinafter, referred to as first roll sheet P), a second roll sheet mode in which printing is performed on a second roll sheet P' (see FIG. 8) having a smaller width (for example, 3-inch width) than that of the first roll sheet P, and a switching operation between the respective modes. Further, in the following, first, description is made of a state in which the pressing force releasing mechanism 51 is kept at the pressing force imparting position.

First, as illustrated in FIG. 2, after the open button 18 is pressed to open the paper cover 20, the first roll sheet P is set. Specifically, the first roll sheet P is set as if being thrown into the roll sheet accommodating portion 21. In this way, the outer peripheral surface of the first roll sheet P is held in a contact state with the inner peripheral surface of the guide plate 23 of the roll sheet accommodating portion 21. Then, the thermal paper P1 is drawn from the first roll sheet P, and a leading edge of the drawn thermal paper P1 is held in contact with the platen roller 34 and the thermal head 33 therebetween. Thereafter, the paper cover 20 is closed. Thus, setting of the first roll sheet P is completed.

Then, when the thermal printer 1 is actuated and the platen roller 34 is rotated, the thermal paper P1 is drawn from the first roll sheet P to be sent out to the downstream side, that is, to the paper outlet 19 in a sandwiched state between the peripheral surface of the platen roller 34 and the thermal head 33. At the same time, the thermal head 33, on which the large number of heating elements 41 generate heat as appropriate, can clearly print letters and figures of various types on the sent-out thermal paper P1. Thereafter, the thermal paper P1 discharged from the paper outlet 19 is tilted and pulled toward the cutting unit 26, and thus the thermal paper P1 is cut. As a result, the thermal paper P1 rolled in the first roll sheet P can be used as a receipt or the like.

In a case of switching from the above-mentioned first roll sheet mode to the second roll sheet mode, after the open button 18 is first pressed to open the paper cover 20, the roll sheet P is taken out of the roll sheet accommodating portion 21.

Thereafter, the second roll sheet P' having a smaller width (for example, 3-inch width) than that of the first roll sheet P is set inside the roll sheet accommodating portion 21 in a similar way to that of the above-mentioned first roll sheet mode. At this time, one widthwise end side of the second roll sheet P' is set so as to align with one side wall 12 of the casing 3.

By the way, in a case of using the second roll sheet P' having a smaller width than that of the first roll sheet P which has a maximum width usable in the thermal printer 1, the gap is formed on an outer side of the second roll sheet P' inside the roll sheet accommodating portion 21 (between the other widthwise end side of the second roll sheet P' and the other side wall 12 of the casing 3). Further, in the gap, the thermal paper P1' is not present between the thermal head 33 and the platen roller 34, and thus the thermal head 33 and the platen roller 34 are brought into direct contact with each other (contact region R in FIG. 6).

Figure 5:
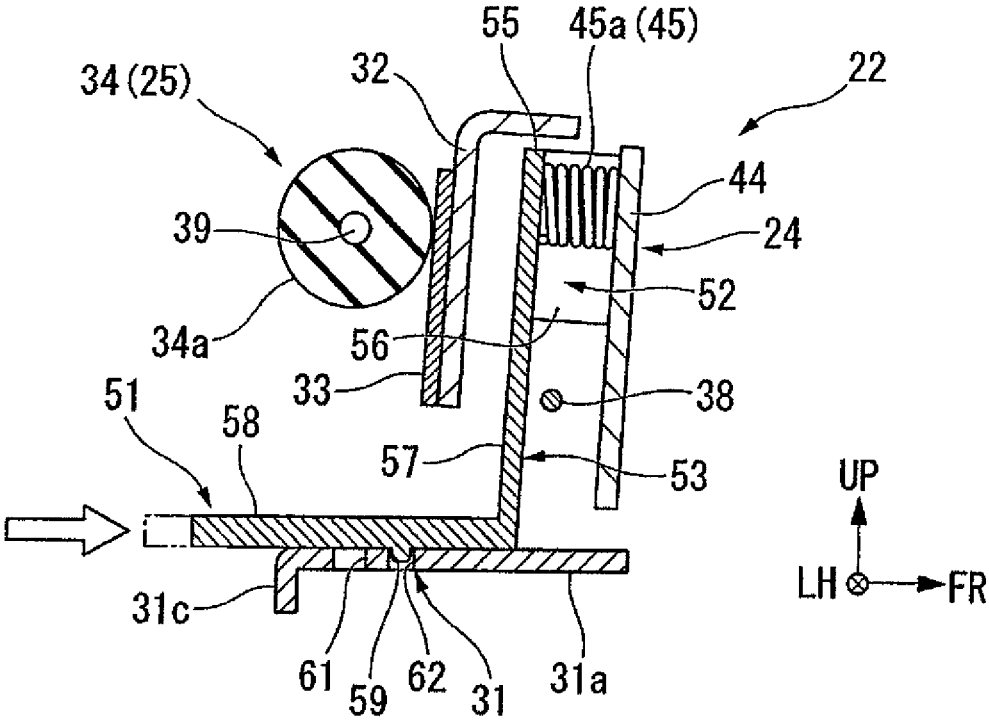
FIG. 5 is an explanatory diagram illustrating a switching operation from a first roll sheet mode to a second roll sheet mode, and is a sectional view corresponding to FIG. 4.
Figure 6:
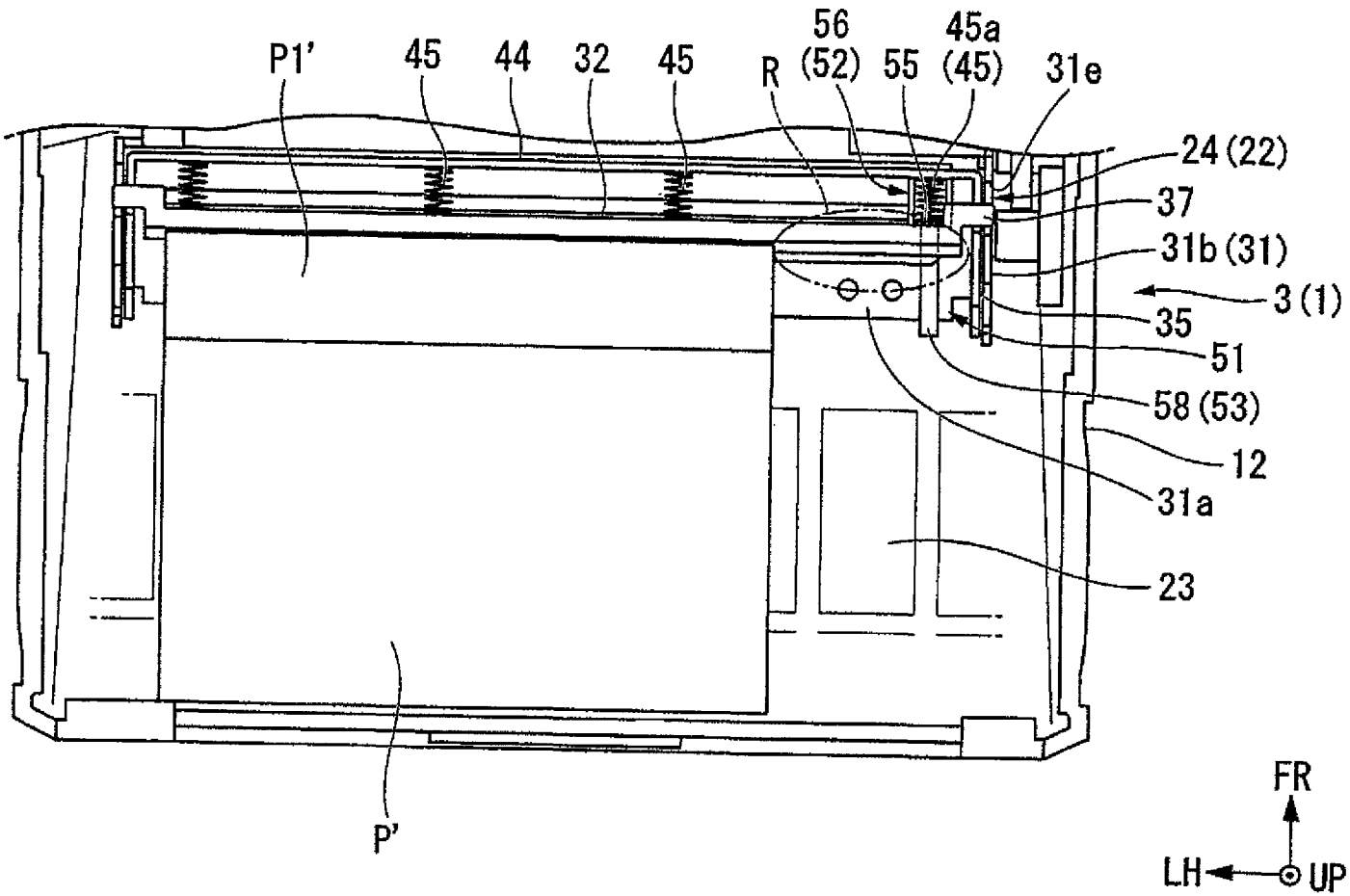
FIG. 6 is an explanatory diagram illustrating the switching operation from the first roll sheet mode to the second roll sheet mode, and is a plan view of a casing.

FIGS. 5 and 6 are explanatory diagrams illustrating the switching operation from the first roll sheet mode to the second roll sheet mode. FIG. 5 is a sectional view corresponding to FIG. 4, and FIG. 6 is a plan view of the casing.

As illustrated in FIGS. 5 and 6, the operation portion 58 is operated to disengage the protruding portion 59 from the positioning hole 61, and the operation portion 58 is pushed forward. Then, the operation portion 58 is moved to a position at which the protruding portion 59 of the operation portion 58 overlaps the positioning hole 62. When the operation portion 58 is moved, the pressing force releasing mechanism 51 is moved forward, and the elastic member 45*a* supported on the bearing surface 52 contracts. In this way, the elastic member 45*a* (bearing surface 52) is separated from the head support member 32. Further, when the protruding portion 59 is received in the positioning hole 62, movement in the front-rear direction of the operation portion 58 is regulated, and the pressing force releasing mechanism 51 is kept at the pressing force releasing position. That is, when the elastic member 45*a* is separated from the head support member 32, the pressing of the head support member 32 by the elastic member 45*a* is released.

With the above-mentioned procedure, the switching operation to the second roll sheet mode is finished. Then, printing on the second roll sheet P' is performed in a similar way to that of the above-mentioned first roll sheet mode.

As described above, when the pressing force releasing mechanism 51 moves the elastic member 45*a* from the pressing force imparting position to the pressing force releasing position, the elastic member 45*a* is separated from the head support member 32, and thus a pressing force acting from the elastic member 45*a* to the head support member 32 can be released. That is, it is possible to avoid direct impartation of the pressing force to a portion at which the thermal head 33 and the platen roller 34 are brought into direct contact with each other.

Note that, at the pressing force releasing position, the elastic member 45*a* imparts a biasing force in a direction so as to separate the bottom wall portion 55 of the bearing surface 52 and the elastic member support plate 44 from each other. However, the pressing force releasing mechanism 51 is regulated in its movement in the front-rear direction when the protruding portion 59 is received in the positioning hole 62, whereas the elastic member support plate 44 is regulated in its swing range by abutting against the main body frame 31. Thus, a distance between the bottom wall portion 55 and the elastic member support plate 44 is kept constant.

Further, in a case of switching from the second roll sheet mode to the first roll sheet mode, it is only necessary to follow a reverse procedure to the above-mentioned procedure. That is, the operation portion 58 is operated to disengage the protruding portion 59 from the positioning hole 62, and the operation portion 58 is pulled rearward. Then, the operation portion 58 is moved to a position at which the protruding portion 59 of the operation portion 58 overlaps the positioning hole 61. When the operation portion 58 is moved, the pressing force releasing mechanism 51 is moved rearward, and the elastic member 45*a* supported on the bearing surface 52 expands. In this way, the elastic member 45*a* abuts against the head support member 32 through intermediation of the bearing surface 52. Further, when the protruding portion 59 is received in the positioning hole 61, movement in the front-rear direction of the operation portion 58 is regulated, and the pressing force releasing mechanism 51 is kept at the pressing force imparting position. That is, the elastic member 45*a* abuts against the head support member 32 through intermediation of the bearing surface 52, to thereby always press the head support member 32 toward the platen roller 34.

With the above-mentioned procedure, the switching operation to the first roll sheet mode is finished.

As described above, in this embodiment, there is adopted a configuration provided with the pressing force releasing mechanism 51 for separating the elastic member 45*a* from the thermal head 33 (head support member 32) according to the width of the roll sheet P fed into the roll sheet accommodating portion 21, and for releasing the pressing of the head support member 32 by the elastic member 45*a*.

With this configuration, in a case of using the second roll sheet P' having a smaller width than that of the first roll sheet P, it is possible to release the pressing force acting from the elastic member 45*a* to the head support member 32. Thus, between the thermal head 33 and the platen roller 34, it is possible to actively reduce contact pressure (platen pressure) between the thermal head 33 and the platen roller 34 in the contact region R, and hence it is possible to reduce friction load between the thermal head 33 and the platen roller 34. Therefore, while reducing damage caused by abrasion between the thermal head 33 and the platen roller 34, it is possible to handle the plurality of kinds of roll sheets P, P' each having a different width in the same apparatus. Further, the reduction of the damage caused by the abrasion enables a longer life of the apparatus.

In addition, when compared to a conventional case in which a plurality of kinds of platen rollers are separately prepared according to the width of the roll sheet P, it is also possible to reduce cost of the apparatus.

Further, in this embodiment, through switching a contact/separated state between the elastic member 45*a* and the head support member 32 by operation of the lever member 53, a user himself/herself can easily perform an operation of releasing the pressing force, which can improve usability. Further, for example, when compared to such a configuration as that requiring detachment of the elastic member 45*a* in order to release the pressing force exerted by the elastic member 45*a*, it is possible to easily perform the operation of releasing the pressing force.

Further, the bearing surface 52 surrounds the both sides of the elastic member 45*a* in the right-left direction, and hence at the time of contraction, movement, and the like of the elastic member 45*a*, it is possible to restrain tilting down of the elastic member 45*a*.

In addition, the protruding portion 59 of the operation portion 58, and the positioning holes 61, 62 (positioning portions) can position the pressing force releasing mechanism 51 at the pressing force imparting position and the pressing force releasing position, and hence it is possible to improve reliability of the apparatus.

Note that, the technical scope of the present invention is not limited to the above-mentioned embodiment, but various modifications can be made without departing from the spirit of the present invention.

For example, in this embodiment, description is made of a case of using the roll sheet which is rolled so as to have the hollow hole, but a roll sheet obtained by rolling the thermal paper around a core may be used.

Further, in the above-mentioned embodiment, of the elastic members 45, the utmost elastic member 45*a* is provided with the pressing force releasing mechanism 51, but the present invention is not limited thereto. An arbitrary one of the elastic members 45 may be provided with the pressing force releasing mechanism 51.

In addition, in the above-mentioned embodiment, description is made of a configuration in which coil springs are used as the elastic members 45, but the present invention is not limited thereto. Plate springs or torsion bars may be used.

Further, in the above-mentioned embodiment, the operation portion 58 of the lever member 53 is extended rearward and can be operated inside the roll sheet accommodating portion 21, but as long as the elastic member 45*a* can be brought into contact with and separated from the head support member 32, design of the configuration of the lever member 53 can be modified as appropriate. For example, the operation portion 58 may be extended forward.

Another Embodiment

Figure 7:
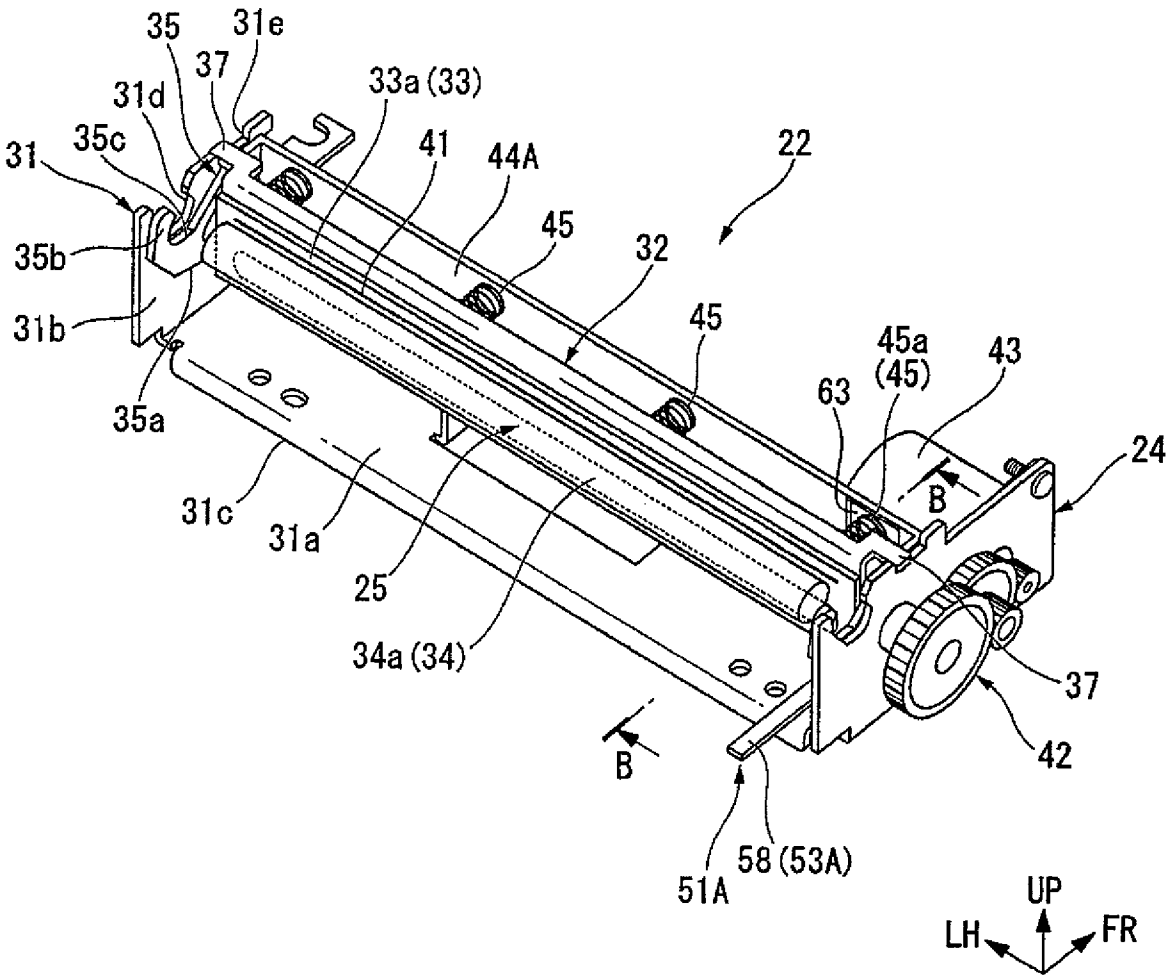
FIG. 7 is a perspective view illustrating a printing module of a thermal printer according to another embodiment of the present invention.
Figure 8:
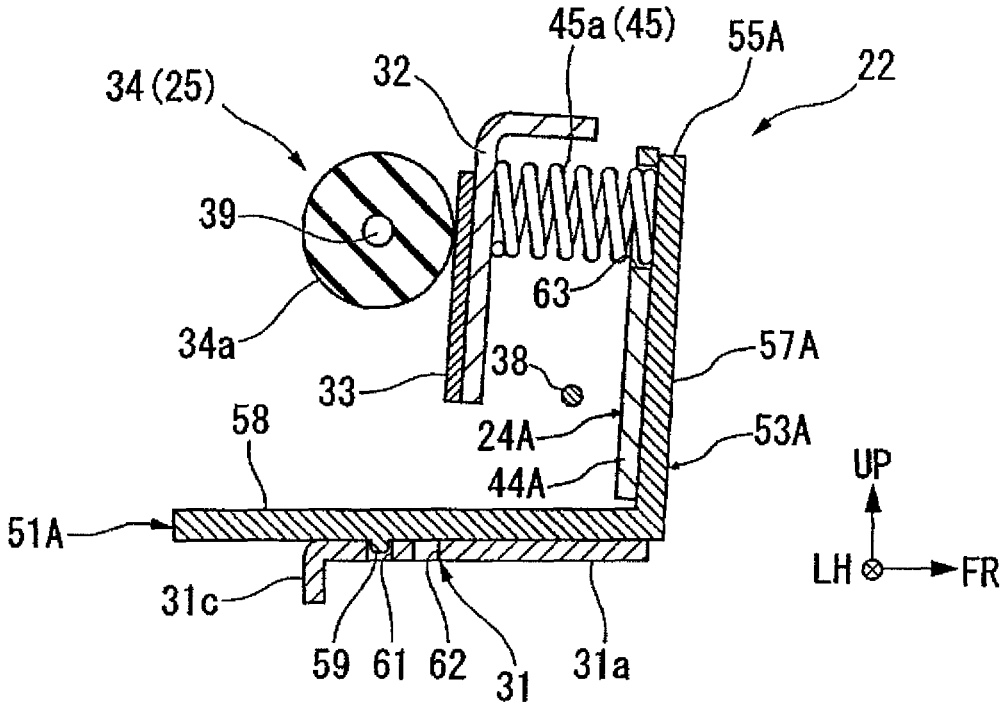
FIG. 8 is a sectional view taken along the line B-B of FIG. 7.
Figure 9:
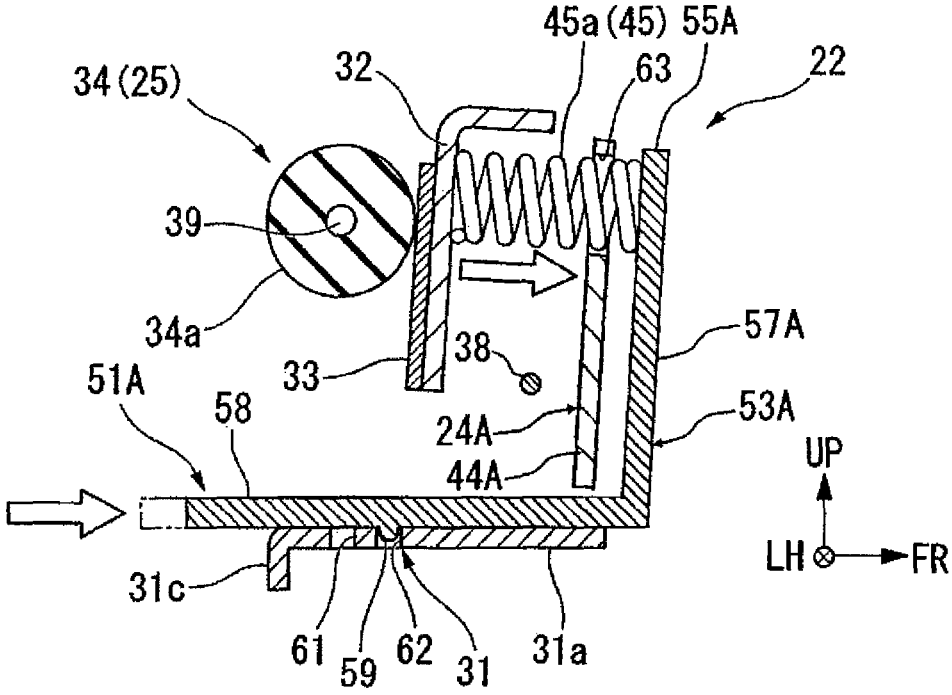
FIG. 9 is an explanatory diagram illustrating a switching operation from a first roll sheet mode to a second roll sheet mode, and is a sectional view corresponding to FIG. 8.

FIG. 7 is a perspective view illustrating a printing module of a thermal printer according to another embodiment of the present invention. Further, FIG. 8 is a sectional view taken along the line B-B of FIG. 7. FIG. 9 is an explanatory diagram illustrating a switching operation from a first roll sheet mode to a second roll sheet mode, and is a sectional view corresponding to FIG. 8. Note that, in those figures, the same members as those of the above-mentioned embodiment are denoted by the same reference symbols, and description thereof is omitted.

As illustrated in FIG. 7, similarly to the above-mentioned embodiment, in the main body unit 24 according to this embodiment, a flat-plate-like elastic member support plate 44A extending substantially in parallel to the head support member 32 is arranged in front of the head support member 32. Between the head support member 32 and the elastic member support plate 44A, the plurality of (four, in this case) elastic members 45 are interposed along the right-left direction. Further, as illustrated in FIG. 8, of the plurality of elastic members 45, one end of the elastic member 45*a*, which is arranged on one end side in the right-left direction (gear transmission mechanism 42 side), passes through an elastic member window portion drilled in the elastic member support plate 44A, and is supported and fixed on a bottom wall portion 55A of a pressing force releasing mechanism 51A provided on a front surface side of the elastic member support plate 44A. Meanwhile, the other end of the elastic member 45*a* abuts against the head support member 32.

The pressing force releasing mechanism 51A includes a lever member 53A for performing an operation of releasing the pressing force, and the flat-plate-like bottom wall portion 55A formed integrally with the lever member to extend along the front surface of the elastic member support plate 44A.

The lever member 53A includes an extending portion 57A extending downward from a lower end portion of the bottom wall portion 55A, and the operation portion 58 extending rearward from a lower end portion of the extending portion 57A. Similarly to the above-mentioned embodiment, on the lower surface of the operation portion 58, the protruding portion 59 protruding downward is formed. The protruding portion 59 can be received in the plurality of positioning holes 61, 62 formed in the bottom wall portion 31*a* of the main body frame 31.

The pressing force releasing mechanism 51A is movable between a pressing force imparting position (see FIG. 8) at which the protruding portion 59 is received in, of the positioning holes 61, 62, the positioning hole 61 formed on the rear side, and a pressing force releasing position (see FIG. 9) at which the protruding portion 59 is received in the positioning hole 62 formed on the front side. That is, the above-mentioned protruding portion 59 and the positioning holes 61, 62 function as positioning portions for positioning the pressing force releasing mechanism 51A at the pressing force imparting position and the pressing force releasing position, respectively. In this case, at the pressing force imparting position, an elastic force of the elastic member 45*a* is generated between the head support member 32 and the bottom wall portion 55A of the pressing force releasing mechanism 51A supported and fixed on the main body frame 31 through the protruding portion 59 and the positioning hole 61, and the elastic member 45*a* presses the head support member 32 toward the platen roller 34. Meanwhile, at the pressing force releasing position, when the bottom wall portion 55A of the pressing force releasing mechanism 51A moves forward (to the right side of FIG. 9), a stroke of the elastic member 45*a* is increased so that the pressing force acting on the head support member 32 is reduced.

Note that, the switching operation between the first roll sheet mode and the second roll sheet mode (that is, the switching operation between the pressing force imparting position and the pressing force releasing position) is performed in a similar way to that of the above-mentioned embodiment, and hence description thereof is omitted here.

As described above, in this embodiment, according to the width of the roll sheet P fed into the roll sheet accommodating portion 21, the stroke of the elastic member 45*a* biasing the head support member 32 toward the platen roller 34 is increased so that the pressing force is reduced. With this configuration, it is possible to obtain the same functions and effects as those of the above-mentioned embodiment.

What is claimed is:

1. A printer for performing printing on a plurality of kinds of roll sheets each having a different width, the printer comprising:

a thermal head comprising a large number of heating elements arranged along a width direction of a thermal paper that is drawn from one of the plurality of kinds of roll sheets;

a platen roller arranged opposite to the thermal head and mounted to undergo rotation for sending out the thermal paper in a state of sandwiching the thermal paper between the thermal head and the platen roller; and a plurality of elastic members arrayed along the width direction and provided on an opposite side of the platen roller with respect to the thermal head for pressing the thermal head toward the platen roller;

wherein only one of the plurality of elastic members is provided with a pressing force releasing mechanism for separating the one elastic member from the thermal head according to a width of the one of the plurality of kinds of roll sheets from which the thermal paper is drawn and for releasing pressing of the thermal head by the one elastic member.

2. A printer according to claim 1, wherein the pressing force releasing mechanism comprises a lever member for moving the one elastic member and for enabling the one elastic member to be brought into contact with and separated from the thermal head.

3. A printer according to claim 2, wherein the pressing force releasing mechanism comprises a positioning portion for keeping the one elastic member at a contact position, at which the one elastic member is brought into contact with the thermal head, and at a separated position, at which the one elastic member is separated from the thermal head.

4. A printer according to claim 1, wherein the pressing force releasing mechanism comprises a positioning portion for keeping the one elastic member at a contact position, at which the one elastic member is brought into contact with the thermal head, and at a separated position, at which the one elastic member is separated from the thermal head.

5. A printer according to claim 1, wherein the one elastic member is arranged at a position corresponding to one end side in the width direction of the thermal paper.

6. A printer according to claim 1, further comprising a head support member for supporting the thermal head; and wherein the pressing force releasing mechanism comprises a bearing surface for supporting the head support member, the bearing surface having a wall portion arranged between the head support member and the one elastic member.

7. A printer according to claim 6, further comprising an elastic member support plate for supporting the plurality of elastic members; and wherein one end of the one elastic member is supported by and abuts the wall portion of the bearing surface and the other end of the one elastic member is supported by and abuts the elastic member support plate.

8. A printer according to claim 6, wherein the pressing force releasing mechanism further comprises a lever member connected to the bearing surface for operating the pressing force releasing mechanism, the lever member having an extending portion extending downward from a lower end portion of the wall portion and having an operation portion extending rearward from the lower end of the extending portion for operation of the pressing force releasing mechanism through gripping of the operation portion.

9. A printer for performing printing on a plurality of kinds of roll sheets each having a different width, the printer comprising:

a thermal head comprising a large number of heating elements arranged along a width direction of a thermal paper that is drawn from one of the plurality of kinds of roll sheets;

a platen roller arranged opposite to the thermal head and mounted to undergo rotation for sending out the thermal paper in a state of sandwiching the thermal paper between the thermal head and the platen roller; and a plurality of elastic members arrayed along the width direction and provided on an opposite side of the platen roller with respect to the thermal head for pressing the thermal head toward the platen roller;

wherein only one of the plurality of elastic members is provided with a pressing force releasing mechanism for moving the one elastic member so as to increase a stroke of the one elastic member according to a width of the one of the plurality of kinds of roll sheets from which the thermal paper is drawn and for reducing pressing of the thermal head by the one elastic member.

10. A printer according to claim 9, wherein the pressing force releasing mechanism comprises a lever member for moving the one elastic member so as to reduce a pressing force acting on the thermal head.

11. A printer according to claim 10, wherein the pressing force releasing mechanism comprises a positioning portion for keeping the one elastic member at a pressing force imparting position, at which the at one elastic member generates an elastic force biasing the thermal head, and at a pressing force releasing position, at which the elastic force is reduced by increasing the stroke of the one elastic member.

12. A printer according to claim 9, wherein the pressing force releasing mechanism comprises a positioning portion for keeping the one elastic member at a pressing force imparting position, at which the one elastic member generates an elastic force biasing the thermal head, and at a pressing force releasing position, at which the elastic force is reduced by increasing the stroke of the one elastic member.

13. A printer according to claim 9, wherein the one elastic member is arranged at a position corresponding to one end side in the width direction of the thermal paper.

14. A printer according to claim 9, further comprising a head support member for supporting the thermal head; and wherein the pressing force releasing mechanism comprises a bearing surface for supporting the head support member, the bearing surface having a wall portion arranged between the head support member and the one elastic member.

15. A printer according to claim 14, further comprising an elastic member support plate for supporting the plurality of elastic members; and wherein one end of the one elastic member is supported by and abuts the wall portion of the bearing surface and the other end of the one elastic member is supported by and abuts the elastic member support plate.

16. A printer according to claim 14, wherein the pressing force releasing mechanism further comprises a lever member connected to the bearing surface for operating the pressing force releasing mechanism, the lever member having an extending portion extending downward from a lower end portion of the wall portion and having an operation portion extending rearward from the lower end of the extending portion for operation of the pressing force releasing mechanism through gripping of the operation portion.

17. A printer for performing printing on a plurality of kinds of roll sheets of thermal paper each having a different width, the printer comprising:

a thermal head;

a platen roller arranged opposite to the thermal head and mounted to undergo rotation for feeding the thermal paper in a state in which the thermal paper is interposed between the thermal head and the platen roller; and a plurality of elastic members provided on an opposite side of the platen roller with respect to the thermal head for pressing the thermal head toward the platen roller, one of the plurality of elastic members being arranged at a position corresponding to one end side in the width direction of the thermal paper, and only the one elastic member being provided with a pressing force releasing mechanism for releasing pressing of the thermal head by the one elastic member.

18. A printer according to claim 17, further comprising a head support member for supporting the thermal head; and wherein the pressing force releasing mechanism comprises a bearing surface for supporting the head support member, the bearing surface having a wall portion arranged between the head support member and the one elastic member.

19. A printer according to claim 18; further comprising an elastic member support plate for supporting the plurality of elastic members; and wherein one end of the one elastic member is supported by and abuts the wall portion of the bearing surface and the other end of the one elastic member is supported by and abuts the elastic member support plate.

20. A printer according to claim 18, wherein the pressing force releasing mechanism further comprises a lever member connected to the bearing surface for operating the pressing force releasing mechanism, the lever member having an extending portion extending downward from a lower end portion of the wall portion and having an operation portion extending rearward from the lower end of the extending portion for operation of the pressing force releasing mechanism through gripping of the operation portion.

* * * * *